US009108762B1

(12) United States Patent
Lin

(10) Patent No.: US 9,108,762 B1
(45) Date of Patent: Aug. 18, 2015

(54) RECYCLABLE PALLET

(71) Applicant: Ching-Wei Lin, New Taipei (TW)

(72) Inventor: Ching-Wei Lin, New Taipei (TW)

( * ) Notice: Subject to any disclaimer, the term of this patent is extended or adjusted under 35 U.S.C. 154(b) by 0 days.

(21) Appl. No.: 14/497,333

(22) Filed: Sep. 26, 2014

(30) Foreign Application Priority Data

Mar. 10, 2014 (CN) ..... 2014 2 0105812

(51) Int. Cl.
*B65D 19/12* (2006.01)
*B65D 19/00* (2006.01)
*B65D 19/06* (2006.01)

(52) U.S. Cl.
CPC ..... *B65D 19/0028* (2013.01); *B65D 19/06* (2013.01); *B65D 2519/00009* (2013.01)

(58) Field of Classification Search
CPC ..... B65D 19/0012; B65D 19/38; B65D 19/0028; B65D 19/06; B65D 2519/00009; B65D 2519/00547; B65D 2519/00552
USPC ..... 108/56.1, 56.3
See application file for complete search history.

(56) References Cited

U.S. PATENT DOCUMENTS 4,128,253 A * 12/1978 Powers ..... 280/79.11
4,267,781 A * 5/1981 Powers ..... 108/56.1
5,197,396 A * 3/1993 Breezer et al. ..... 108/56.3
5,329,862 A * 7/1994 Breezer et al. ..... 108/55.5
5,351,628 A * 10/1994 Breezer et al. ..... 108/56.1
5,413,052 A * 5/1995 Breezer et al. ..... 108/56.1
7,938,070 B2 * 5/2011 Shea ..... 108/56.3
8,087,364 B2 * 1/2012 Huang-Jung ..... 108/56.3
8,291,837 B2 * 10/2012 Kirkpatrick ..... 108/56.1
2008/0066657 A1 * 3/2008 Kuo ..... 108/57.19
2008/0105168 A1 * 5/2008 Lee ..... 108/56.1
2009/0211498 A1 * 8/2009 Shea ..... 108/57.29

* cited by examiner

*Primary Examiner* — Daniel Rohrhoff
(74) *Attorney, Agent, or Firm* — Leong C. Lei

(57) ABSTRACT

The recyclable pallet contains an upper board(1), caps(4), support tubes(2), stands(3), and bolts(5). The upper board(1) has a number of through upper board holes(11), each surrounded by a number of slots(12). Each cap(4) has a through cap hole(41) and a number of protrusions(42) extended downward from the cap(4)'s circumference. Each protrusion (42) corresponds to and is plugged downward into a slot(12). Each support tube(2) has a through axial channel(21) and positioned beneath the upper board(1). Each stand(3) has a platform(31) on an upper side plugged into a lower end of a support tube(2). An axial pin(32) is extended upward from an upper side of the platform(31). An upper end of each axial pin(32) has an axial bolt hole(321). Each bolt(5) is threaded downward through a cap hole(41), an upper board hole(11), and then screwed into the bolt hole(321) of a pin(32) of a stand(3).

7 Claims, 14 Drawing Sheets

RECYCLABLE PALLET

TECHNICAL FIELD OF THE INVENTION

The present invention is generally related to pallets, and more particular to a pallet of significant strength which is made of recycled paper, recycled plastic material, and recycled metallic material, and can be recycled itself.

DESCRIPTION OF THE PRIOR ART

A pallet is commonly used to supports goods in a stable manner while being lifted by a forklift, pallet jack, front loader, or other jacking device.

Early pallets are made of wood, and a wooden pallet usually contains a number of deckboards supported by several stringers so that the fork of a forklift can be inserted between the strings and lifts the pallet.

Wooden pallets are heavy and difficult to store when not in use. Therefore there are plastic pallets or even foldable pallets. However, plastic pallets still suffer similar storage problem and are not environmentally friendly. Foldable pallets are complex in their structures, costly, and may be inferior in strength.

SUMMARY OF THE INVENTION

The objective of the present invention to provide a pallet of significant strength which is made of recycled paper, recycled plastic material, and recycled metallic material, and can be recycled itself. The pallet can be easily dis-assembled and stored when it is not in use, and quickly put together to put to use.

A feature of the present invention is that recycled paper is used to make an upper board and a number of support tubes, recycle plastic material is used to make a number of caps and stands, and recycled metallic material is used to make a number of bolts. The support tubes support the upper board from below. The stands are joined to the support tubes' lower ends. The caps are joined to the upper board. The bolts run through the cap, the upper board, and then are fastened to the stand and a pallet of enhanced strength is formed. When the bolts are removed, the upper board, caps, support tubes, and stands are separated for convenient storage.

Another feature of the present invention is that a number of lower boards are positioned between the support tubes and the stands so as to prevent the support tubes from getting damped.

The recyclable pallet contains an upper board, caps, support tubes, stands, and bolts. The upper board mainly contains fluted corrugated sheets made of recycled paper. The upper board has a number of through upper board holes, each surrounded by a number of slots. Each cap is made of recycled plastic material, and has a through cap hole and a number of protrusions extended downward from the cap's circumference. Each protrusion corresponds to and is plugged downward into a slot. Each support tube is made of recycled paper, and has a through axial channel and is positioned beneath the upper board. Each stand is made of recycled plastic material, and has a platform on an upper side plugged into a lower end of a support tube. An axial pin is extended upward from an upper side of the platform. An upper end of each axial pin has an axial bolt hole. Each bolt is made of recycled metallic material, and is threaded downward through a cap hole, an upper board hole, and then screwed into the bolt hole of a pin of a stand. The recycled pallet is as such assembled.

Each platform is plugged upward into a lower end of a support tube's through channel.

The recycled pallet further contains fa number of first lower boards, each having a plurality of through lower board holes. The pin of each stand is plugged upward into a first lower board hole; and each first lower board is sandwiched between a number of support tubes and a number of stands. The lower ends of the support tubes are as such prevented from getting damped.

Each first lower board has two upwardly extended walls along two major sides of the first lower board; and the distance between the two opposing walls on each first lower board is identical to the outer diameter of each support tube. Each first lower board is sandwiched between a number of stands and a number of support tubes. The support tubes are limited by the walls so that the support tubes are prevented from deformation by external forces.

The upper board has upwardly extended walls along a circumference of the upper board so that goods on the pallet are prevented from falling off the pallet.

Therefore, the pallet of the present invention is made of recycled material and can be recycled itself so as to achieve superior environmental friendliness. The pallet can be easily dis-assembled and stored when it is not in use, and quickly put together to put to use. In addition, the pallet has enhanced strength and can withstand goods stacked to a greater height of a greater weight without collapse.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become apparent to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
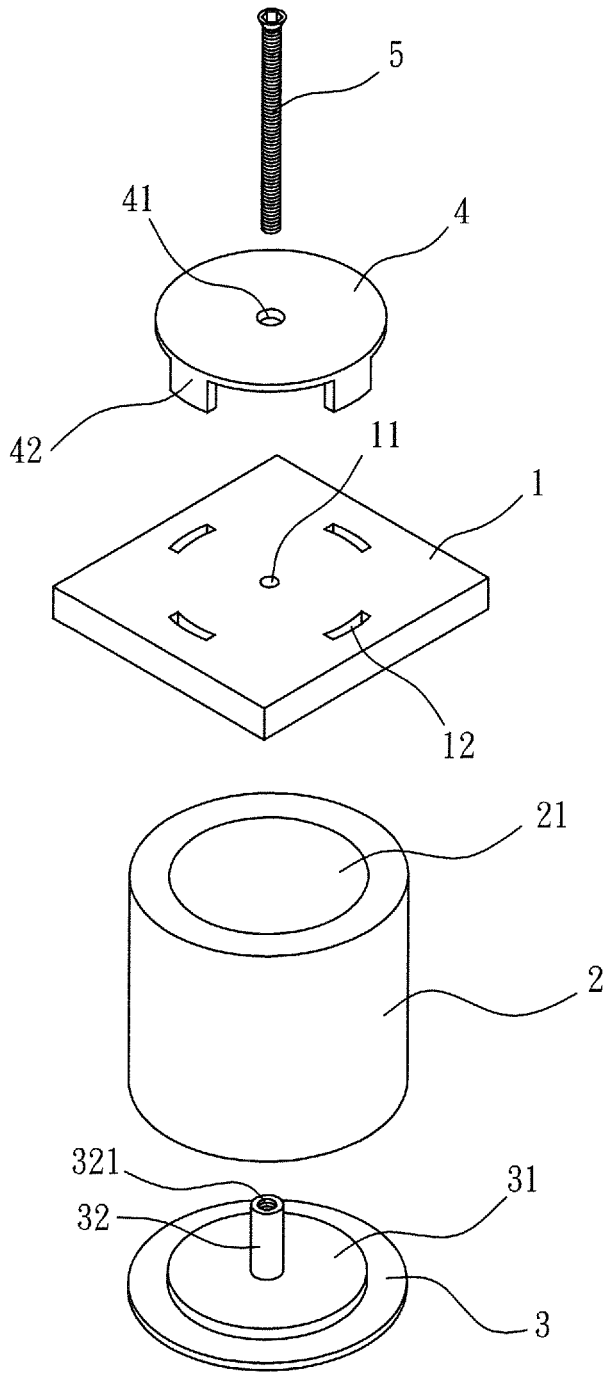
FIG. 1 is a perspective break-down diagram showing a unit of a pallet according to the present invention.
Figure 2:
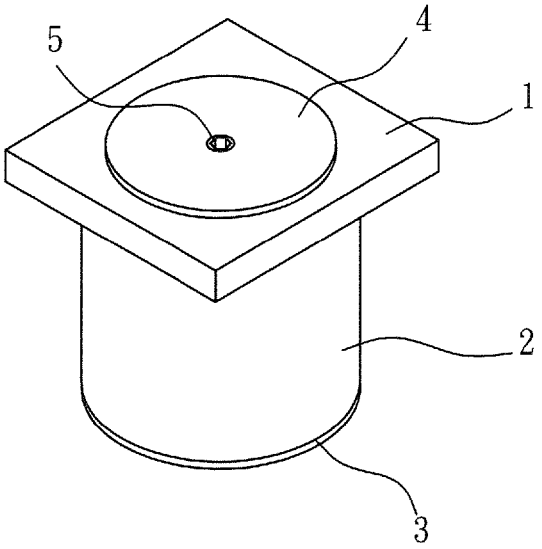
FIG. 2 is a perspective diagram showing the unit of the pallet of FIG. 1.
Figure 3:
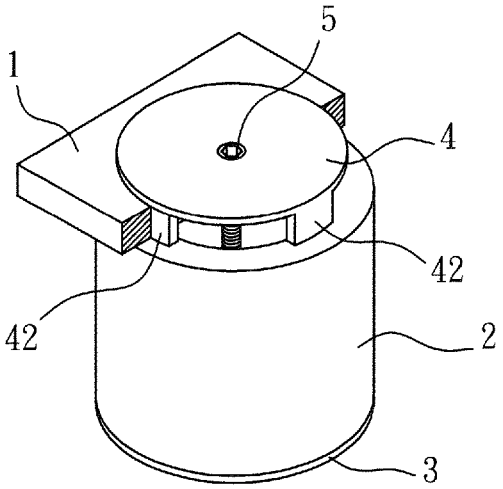
FIG. 3 is a perspective schematic diagram showing the unit of the pallet of FIG. 1.
Figure 4A:
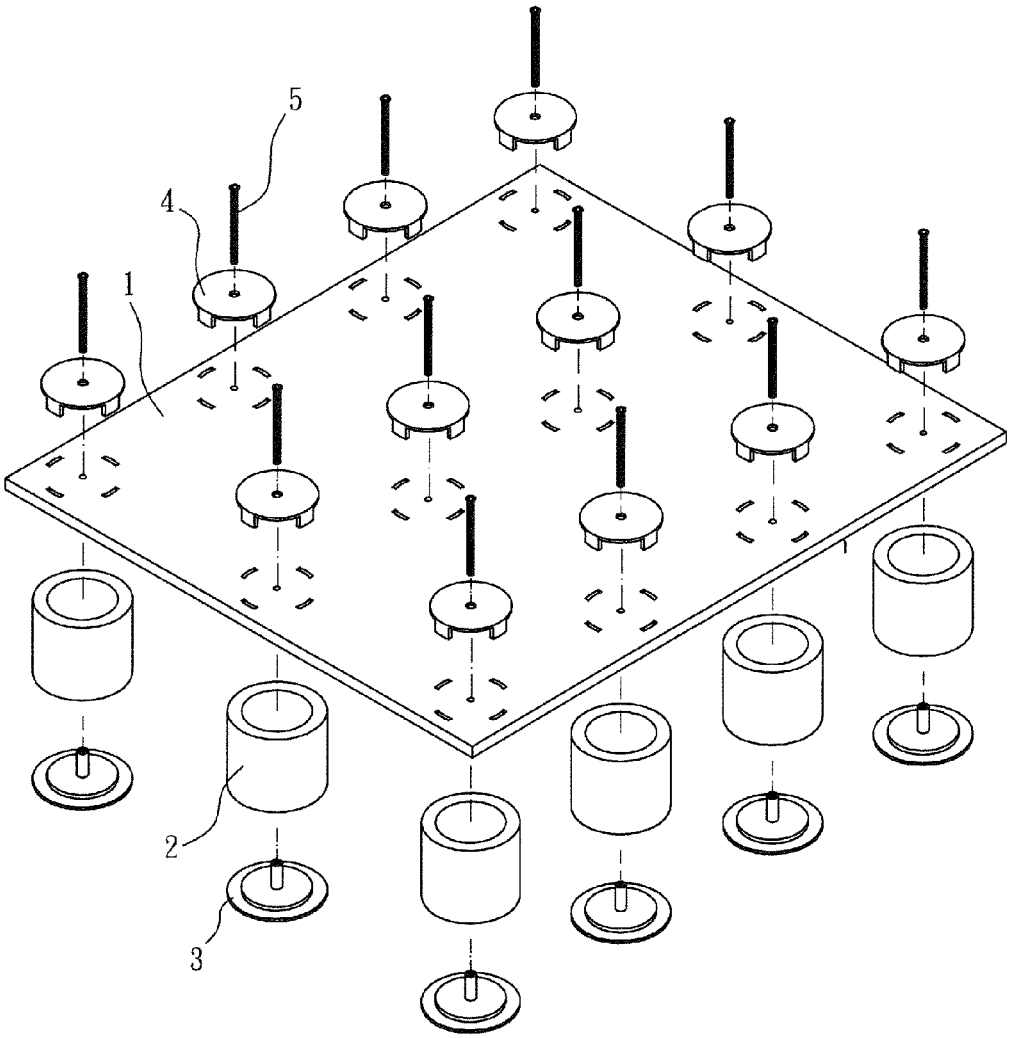
FIG. 4A is a perspective break-down diagram showing a pallet according to a first embodiment of the present invention.
Figure 4B:
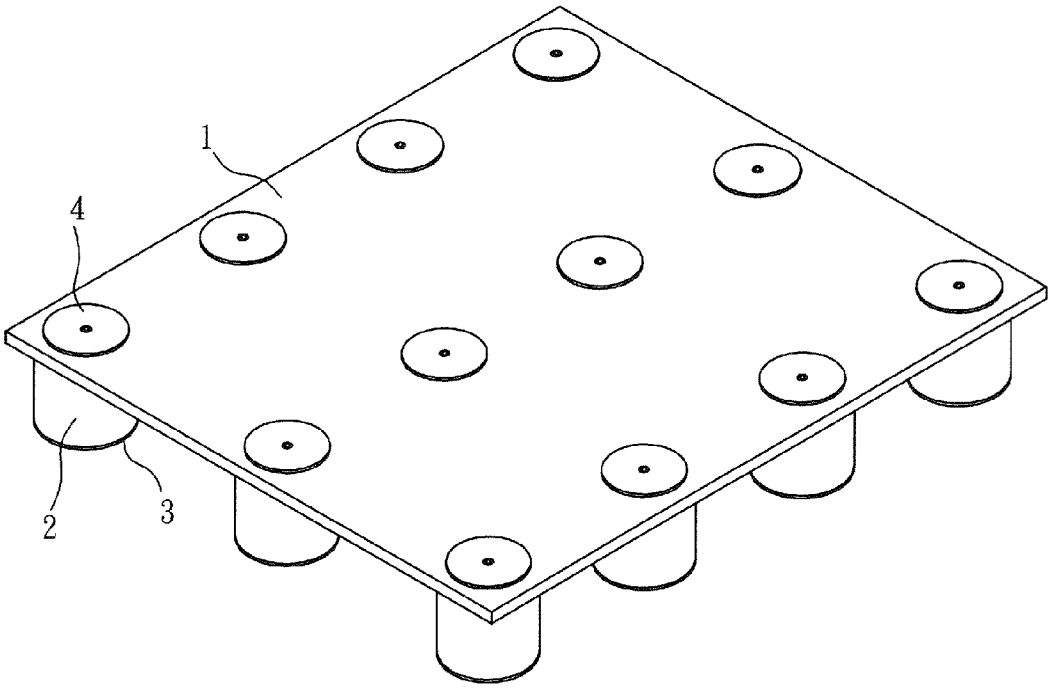
FIG. 4B is a perspective diagram showing the pallet of FIG. 4A after assembly.

As shown in FIGS. 4A and 4B, a pallet according to a first embodiment of the present invention contains an upper board 1, a number of support tubes 2, a number of stands 3, a number of caps 4, and a number of bolts 5. The upper board 1 contains a fluted corrugated sheet sandwiched between flat linerboards, all made of recycled paper. As further shown in FIGS. 1 to 3, the upper board 1 has a number of holes 11, and each hole 11 is surrounded by a number of slots 12. Each hole 11 and its surrounding slots 12 constitute a unit and the pallet contains a number of units, preferably arranged in an array.

Each cap 4 is made of recycled plastic material, and has a hole 41 and a number of protrusions 42 extended downward from the cap 4's circumference. The protrusions 42 correspond to the slots 12 surrounding a hole 11. As the protrusions 42 are plugged into the slots 12, the hole 41 is aligned with the hole 11.

Each support tube 2 is made of recycled paper. Each support tube 2 contains an axial through channel 21 surrounded by a fluted corrugated sheet sandwiched between flat linerboards as the support tube 2's inner and outer walls. Each support tube 2 is positioned beneath the upper board 1 and its inner and outer diameters are such that the projection of the slots 12 of a unit falls between the inner and outer diameters of the support tube 2. The protrusions 42, as they are plugged into the slots 12, will also penetrate into an upper end of the support tube 2 between the support tube 2's inner and outer walls.

The stands 3 are made of recycled plastic material. Each stand 3 has a platform 31 on an upper side of the stand 3 whose outer diameter matches the inner diameter of each support tube 2. On an upper side of the platform 31, an axial pin 32 is extended upward for an appropriate height. In an upper end of each axial pin 32, there is an axial bolt hole 321.

The bolts 5 are made of recycled metallic material.

A pallet according to the present embodiment is assembled as follows. Firstly, the stands 3 are joined to the support tubes 2 by plugging their platforms 31 into the through channels 21's lower ends. Each support tube 2 is then positioned beneath the upper board 1 so that the through channel 21 is axially aligned with a hole 11 of a unit. Each cap 4 is joined to the upper board 1 by plugging its protrusions 42 into the slot 12 of a unit, and then into an upper end of a support tube 2 between the support tube 2's inner and outer diameters, as shown in FIG. 3. Finally, each bolt 5 is threaded through the hole 41 of a cap 4, the hole 11 of a unit of the upper board 1, and then screwed into the bolt hole 321 of a stand 3's pin 32. The upper board 1, the support tubes 2, the stands 3, and the caps 4 are as such assembled into a pallet as shown in FIG. 4B.

Figure 5A:
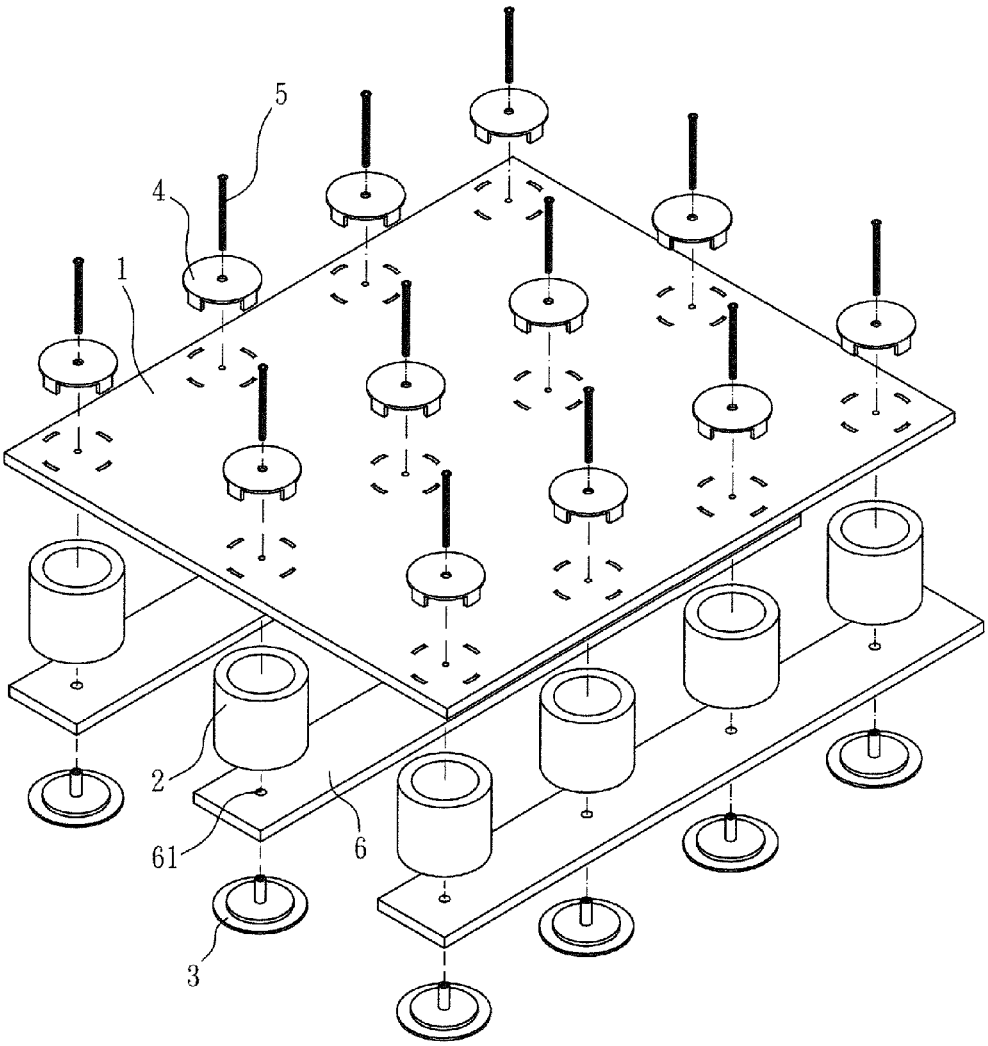
FIG. 5A is a perspective break-down diagram showing a pallet according to a second embodiment of the present invention.
Figure 5B:
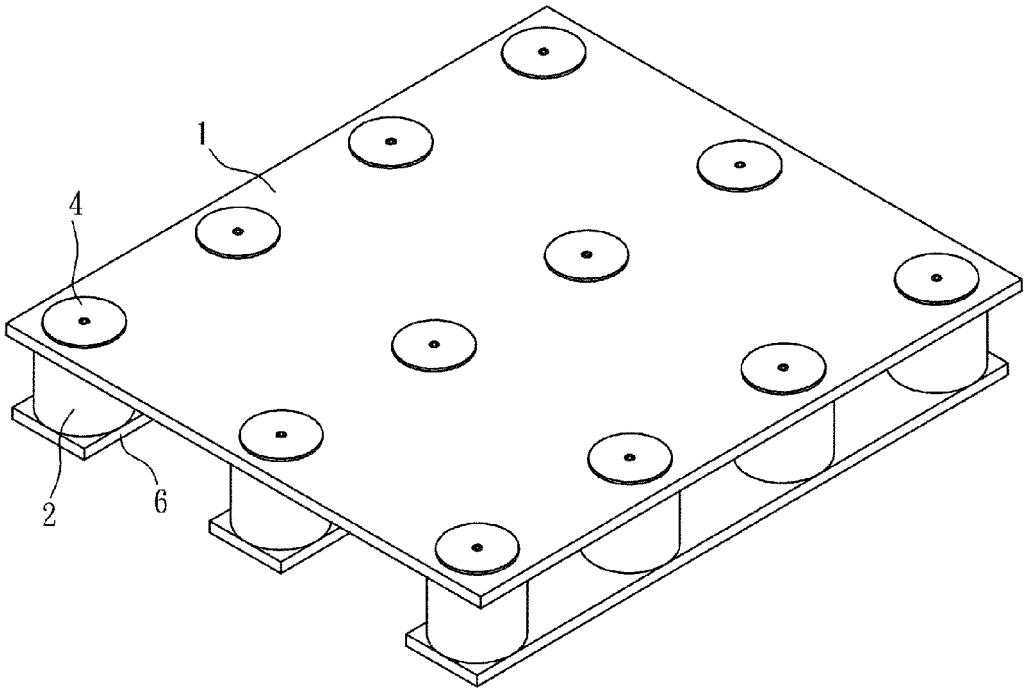
FIG. 5B is a perspective diagram showing the pallet of FIG. 5A after assembly.

As shown in FIGS. 5A and 5B, a pallet according to a second embodiment of the present invention contains an upper board 1, a number of support tubes 2, a number of stands 3, a number of caps 4, a number of bolts 5, and a number of lower boards 6. The lower boards 6 are made of wood, and each lower board 6 has a number of holes 61. A pallet according to the present embodiment is assembled as follows. Firstly, the stands 3 are joined to the lower boards 6 by plugging their axial pins 32 on the platforms 31 into the holes 61 of the lower boards 6. Each support tube 2 is then positioned on a lower board 6 and beneath the upper board 1 so that the through channel 21 is axially aligned with a hole 11 of a unit. Each cap 4 is joined to the upper board 1 by plugging its protrusions 42 into the slot 12 of a unit, and then into an upper end of a support tube 2 between the support tube 2's inner and outer diameters, as shown in FIG. 3. Finally, each bolt 5 is threaded through the hole 41 of a cap 4, the hole 11 of a unit of the upper board 1, and then screwed into the bolt hole 321 of a stand 3's pin 32. The upper board 1, the support tubes 2, the stands 3, the caps 4, and the lower boards 6 are as such assembled into a pallet as shown in FIG. 5B. The lower boards 6 prevent the lower ends of the support tubes 2 from contacting the ground directly so that the support tubes 2 are not damped.

Figure 6A:
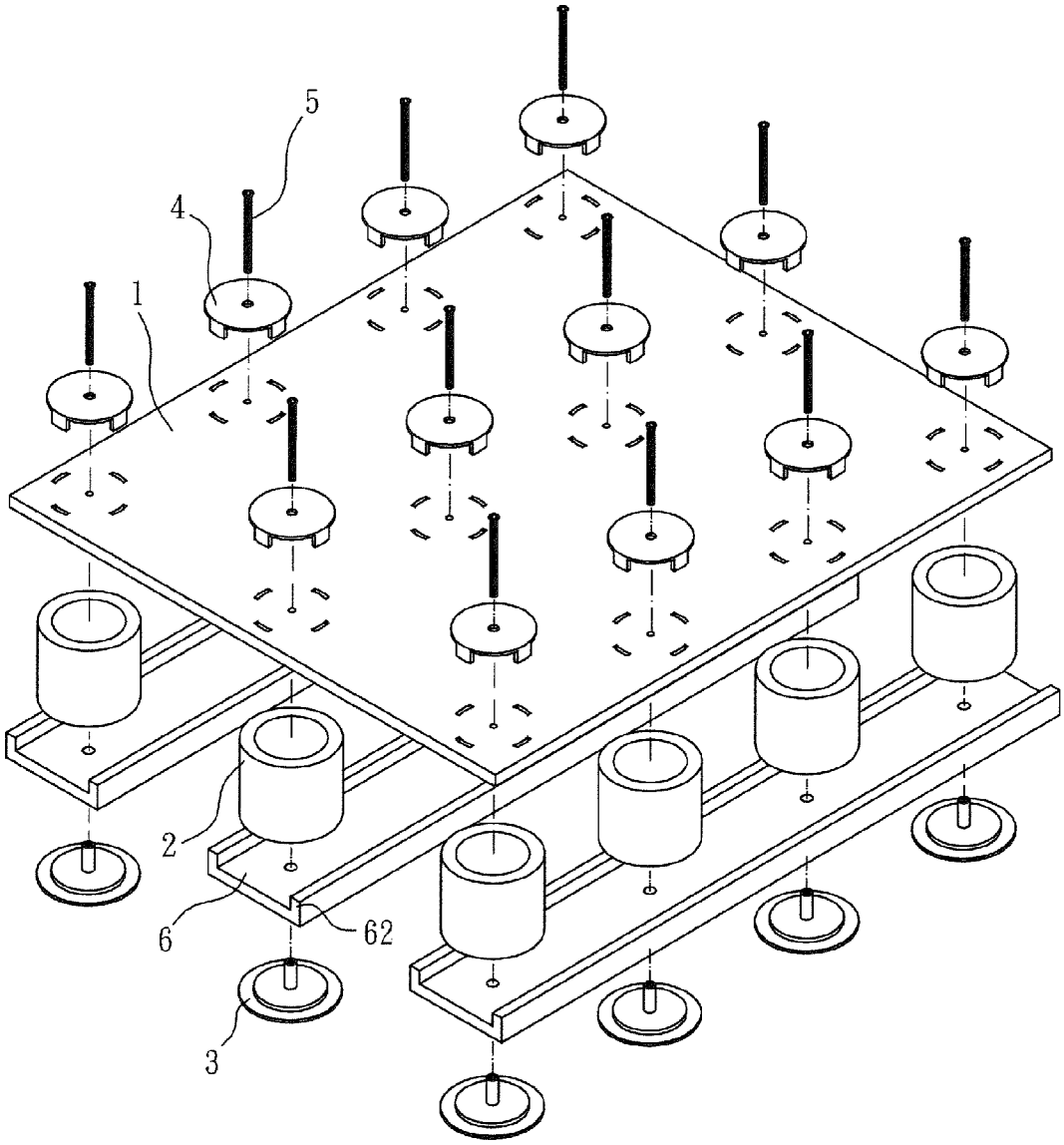
FIG. 6A is a perspective break-down diagram showing a pallet according to a third embodiment of the present invention.
Figure 6B:
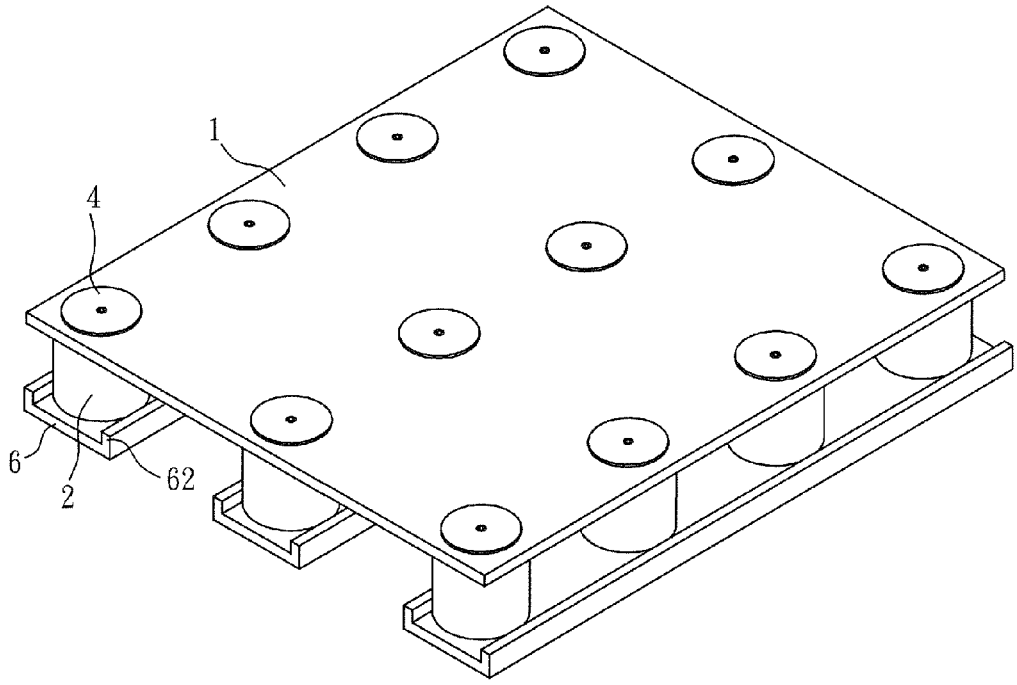
FIG. 6B is a perspective diagram showing the pallet of FIG. 6A after assembly.

As shown in FIGS. 6A and 6B, a pallet according to a third embodiment of the present invention contains an upper board 1, a number of support tubes 2, a number of stands 3, a number of caps 4, a number of bolts 5, and a number of lower boards 6. The present embodiment is different from the previous embodiments in that each lower board 6 has two upwardly extended walls 62 along two major sides of each lower board 6, and the distance between the two opposing walls 62 on each lower board 6 is identical to the outer diameter of each support tube 2. A pallet according to the present embodiment is assembled as follows. Firstly, the stands 3 are joined to the lower boards 6 by plugging their axial pins 32 on the platforms 31 into the holes 61 of the lower boards 6. Each support tube 2 is then positioned on a lower board 6 and beneath the upper board 1 so that the through channel 21 is axially aligned with a hole 11 of a unit. Each cap 4 is joined to the upper board 1 by plugging its protrusions 42 into the slot 12 of a unit, and then into an upper end of a support tube 2 between the support tube 2's inner and outer diameters, as shown in FIG. 3. Finally, each bolt 5 is threaded through the hole 41 of a cap 4, the hole 11 of a unit of the upper board 1, and then screwed into the bolt hole 321 of a stand 3's pin 32. The upper board 1, the support tubes 2, the stands 3, the caps 4, and the lower boards 6 are as such assembled into a pallet as shown in FIG. 6B. The lower boards 6 prevent the lower ends of the support tubes 2 from contacting the ground directly so that the support tubes 2 are not damped. Additionally, each support tube 2 is limited and reinforced by the walls 62 so that the support tube 2 is not displaced or deformed by external forces.

Figure 7A:
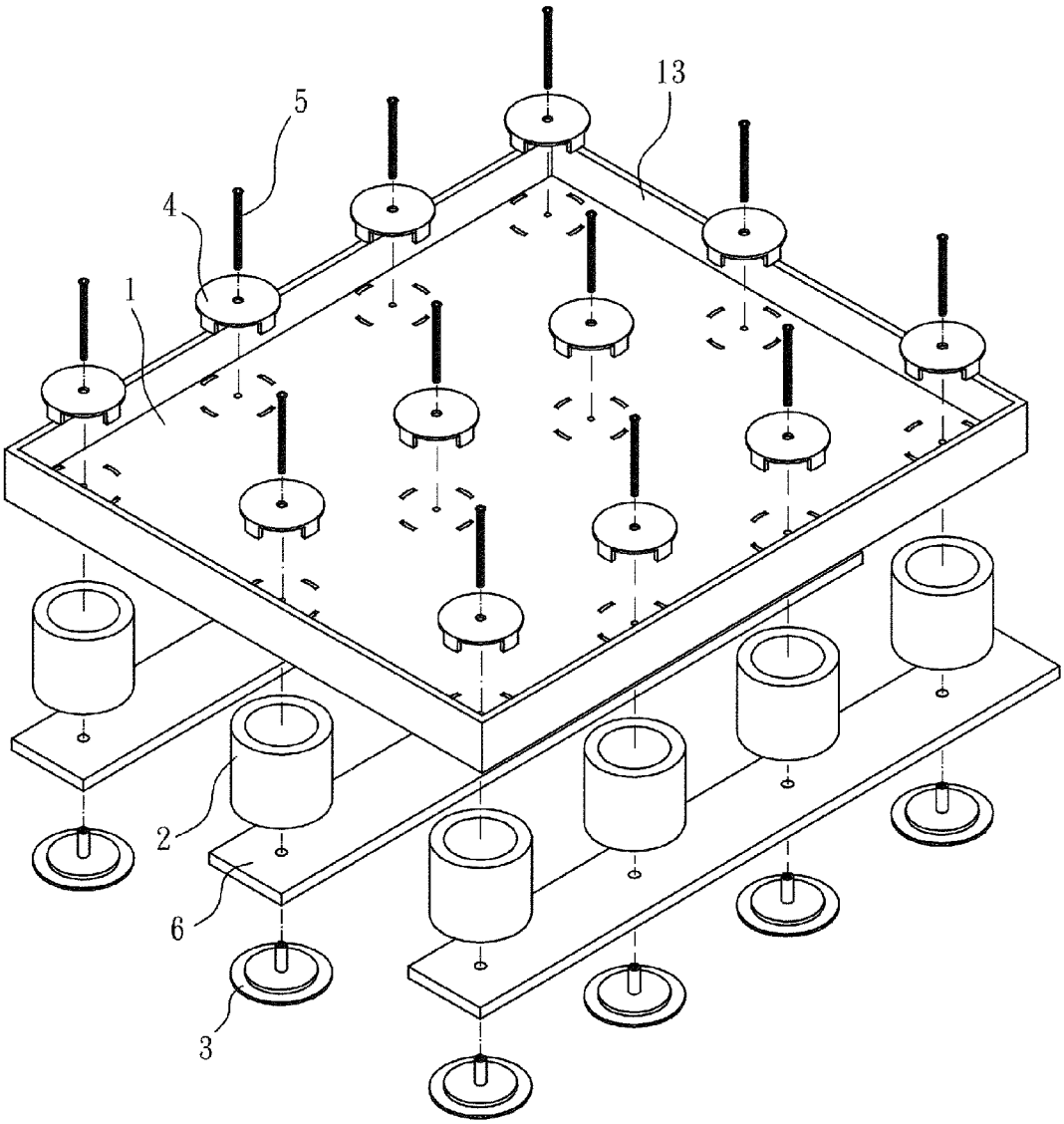
FIG. 7A is a perspective break-down diagram showing a pallet according to a fourth embodiment of the present invention.
Figure 7B:
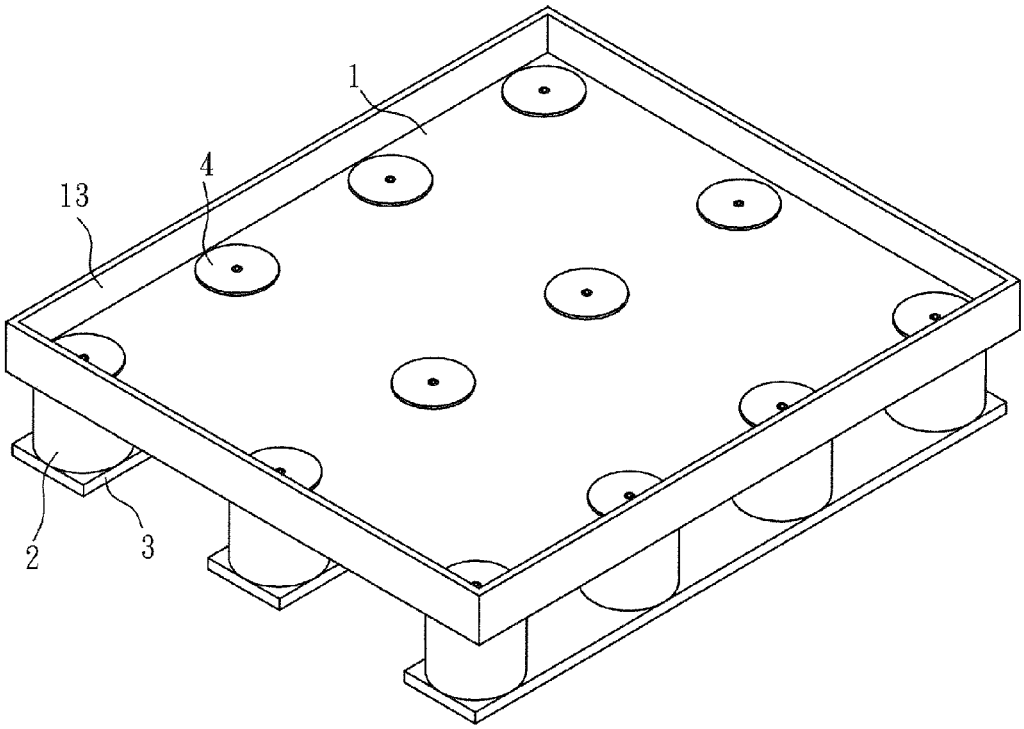
FIG. 7B is a perspective diagram showing the pallet of FIG. 7A after assembly.

As shown in FIGS. 7A and 7B, a pallet according to a fourth embodiment of the present invention contains an upper board 1, a number of support tubes 2, a number of stands 3, a number of caps 4, a number of bolts 5, and a number of lower boards 6. The present embodiment is different from the previous embodiments in that the upper board 1 has upwardly extended walls 13 along a circumference of the upper board 1. A pallet according to the present embodiment is assembled as follows. Firstly, the stands 3 are joined to the lower boards 6 by plugging their axial pins 32 on the platforms 31 into the holes 61 of the lower boards 6. Each support tube 2 is then positioned on a lower board 6 and beneath the upper board 1 so that the through channel 21 is axially aligned with a hole 11 of a unit. Each cap 4 is joined to the upper board 1 by plugging its protrusions 42 into the slot 12 of a unit, and then into an upper end of a support tube 2 between the support tube 2's inner and outer diameters, as shown in FIG. 3. Finally, each bolt 5 is threaded through the hole 41 of a cap 4, the hole 11 of a unit of the upper board 1, and then screwed into the bolt hole 321 of a stand 3's pin 32. The upper board 1, the support tubes 2, the stands 3, the caps 4, and the lower boards 6 are as such assembled into a pallet as shown in FIG. 7B. The walls 13 surrounding the upper side of the upper board 1 prevents goods on the pallet from falling off the pallet.

Figure 8A:
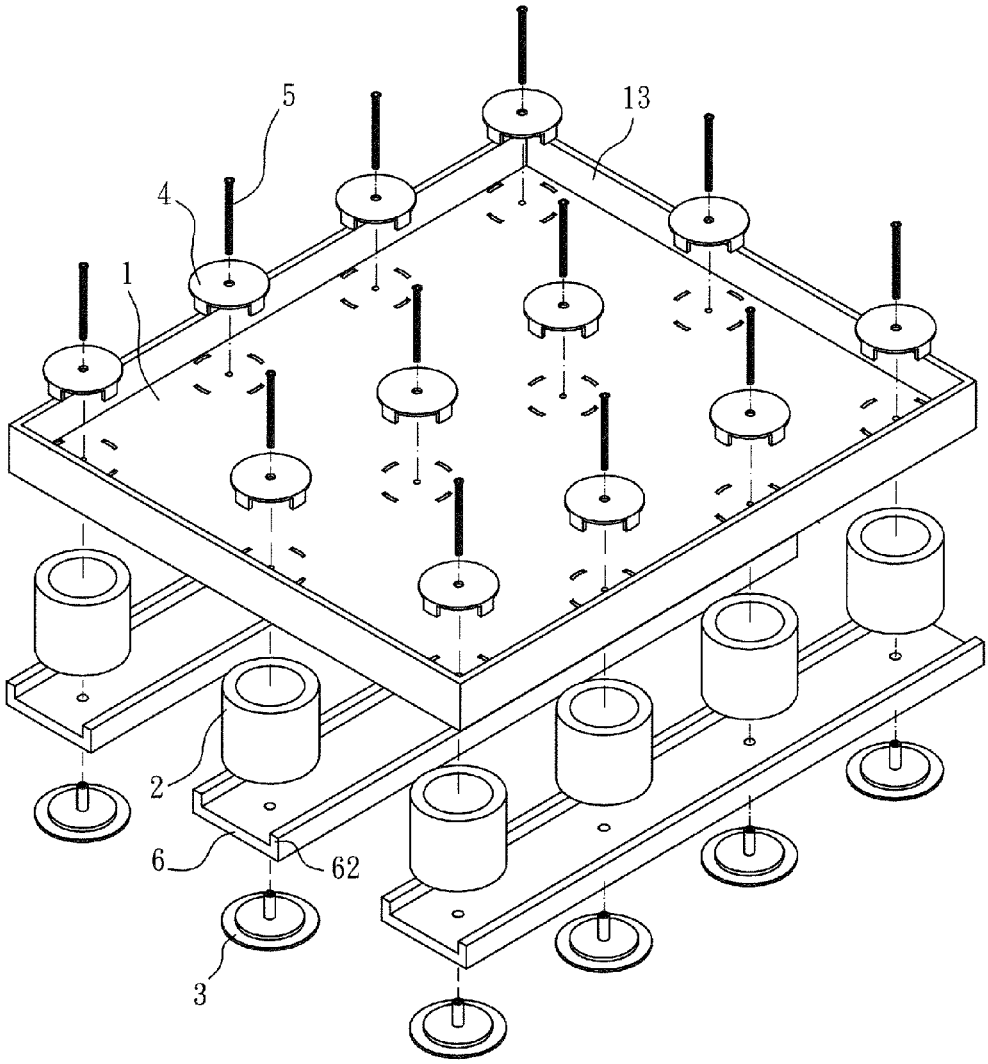
FIG. 8A is a perspective break-down diagram showing a pallet according to a fifth embodiment of the present invention.
Figure 8B:
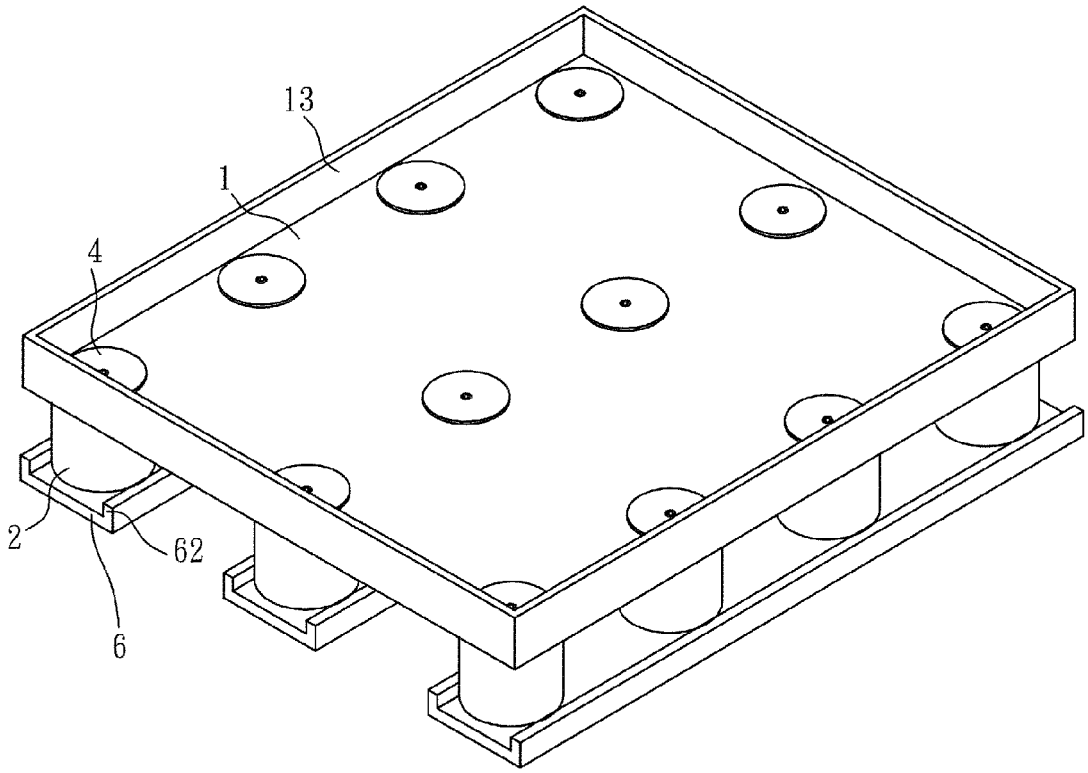
FIG. 8B is a perspective diagram showing the pallet of FIG. 8A after assembly.

As shown in FIGS. 8A and 8B, a pallet according to a fifth embodiment of the present invention contains an upper board 1, a number of support tubes 2, a number of stands 3, a number of caps 4, a number of bolts 5, and a number of lower boards 6. The present embodiment is basically a combination of the third and fourth embodiments in that the upper board 1 has upwardly extended walls 13 along a circumference of the upper board 1, and that each lower board 6 has two upwardly extended walls 62 along two major sides of each lower board 6. A pallet according to the present embodiment is assembled as follows. Firstly, the stands 3 are joined to the lower boards 6 by plugging their axial pins 32 on the platforms 31 into the holes 61 of the lower boards 6. Each support tube 2 is then positioned on a lower board 6 and beneath the upper board 1 so that the through channel 21 is axially aligned with a hole 11 of a unit. Each cap 4 is joined to the upper board 1 by plugging its protrusions 42 into the slot 12 of a unit, and then into an upper end of a support tube 2 between the support tube 2's inner and outer diameters, as shown in FIG. 3. Finally, each bolt 5 is threaded through the hole 41 of a cap 4, the hole 11 of a unit of the upper board 1, and then screwed into the bolt hole 321 of a stand 3's pin 32. The upper board 1, the support tubes 2, the stands 3, the caps 4, and the lower boards 6 are as such assembled into a pallet as shown in FIG. 8B. The walls 13 surrounding the upper side of the upper board 1 prevents goods on the pallet from falling off the pallet. The lower boards 6 prevent the lower ends of the support tubes 2 from contacting the ground directly so that the support tubes 2 are not damped. Additionally, each support tube 2 is limited and reinforced by the walls 62 so that the support tube 2 is not displaced or deformed by external forces.

Figure 9A:
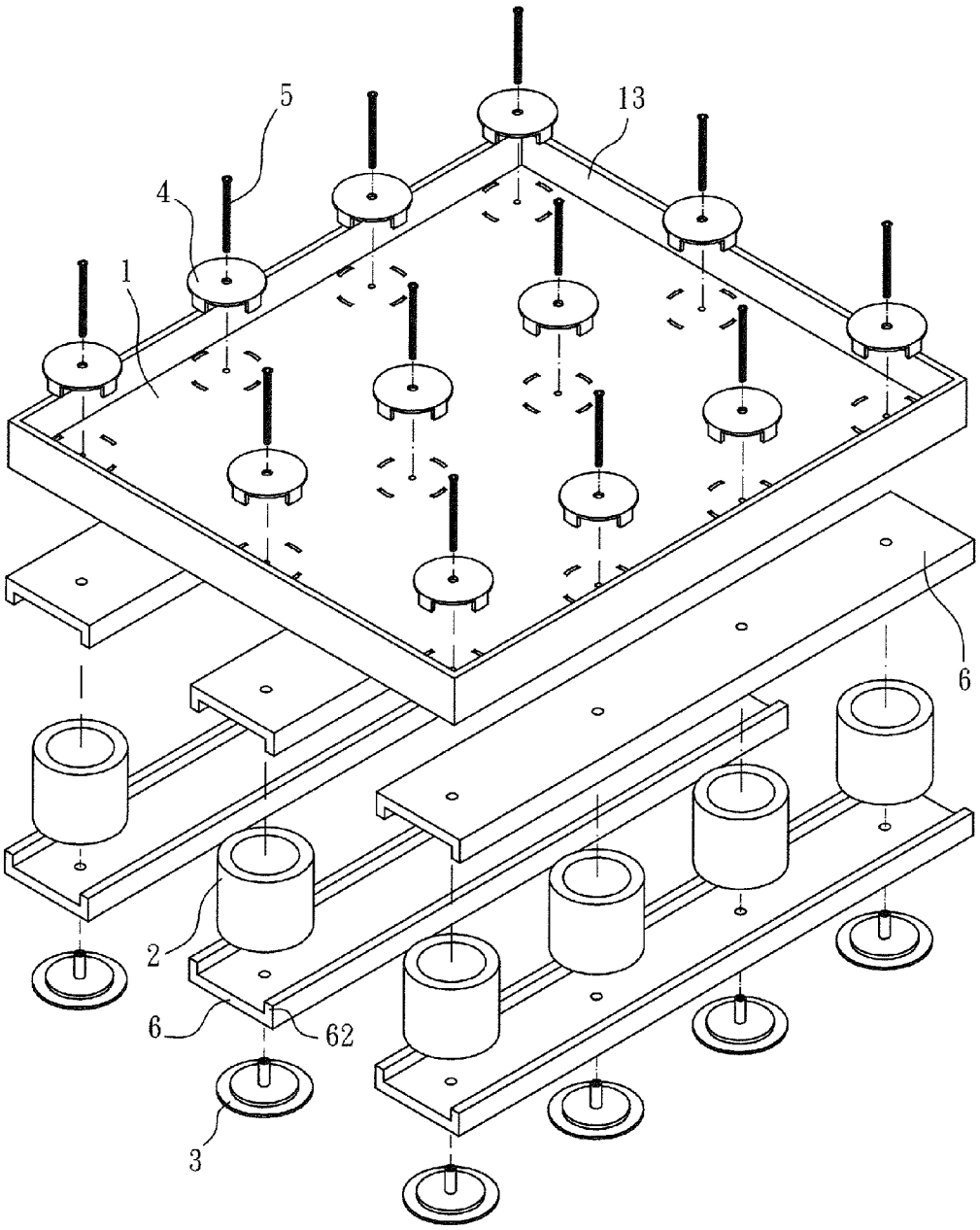
FIG. 9A is a perspective break-down diagram showing a pallet according to a sixth embodiment of the present invention.
Figure 9B:
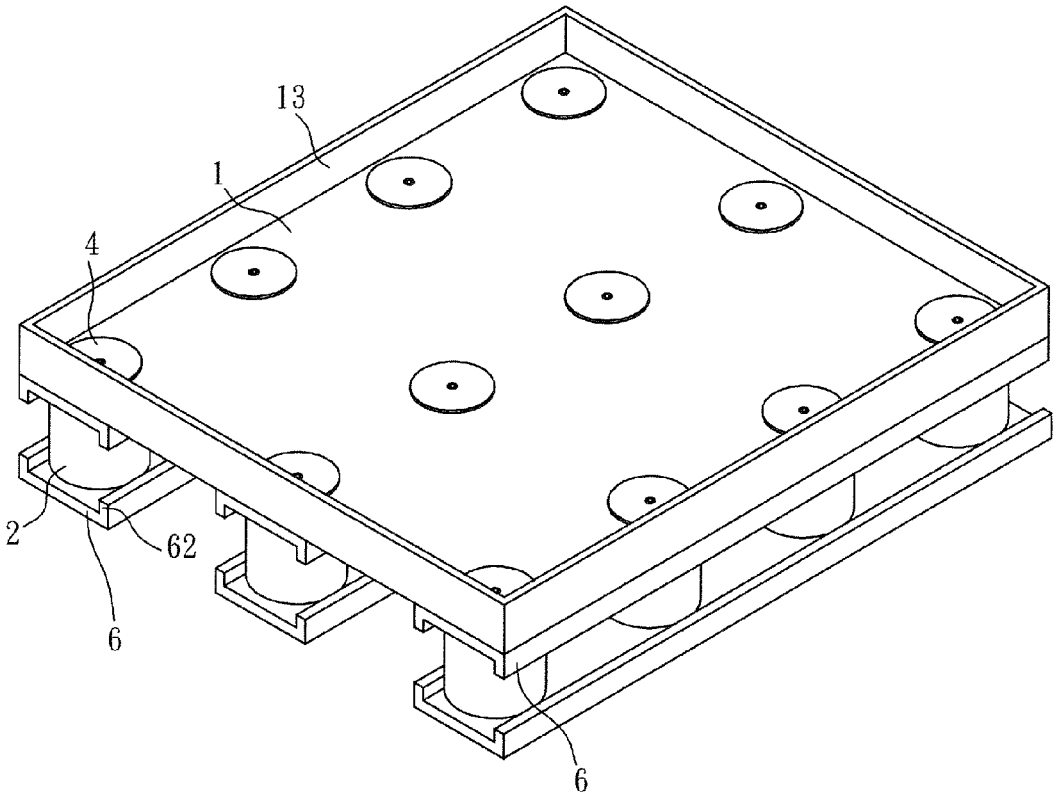
FIG. 9B is a perspective diagram showing the pallet of FIG. 9A after assembly.

As shown in FIGS. 9A and 9B, a pallet according to a sixth embodiment of the present invention contains an upper board 1, a number of support tubes 2, a number of stands 3, a number of caps 4, a number of bolts 5, and a number of first and second lower boards 6. The preset embodiment is different from the previous embodiments in that each support tube 2 is vertically sandwiched between a first lower board 6 and a second lower board 6. Each first lower board 6 has two upwardly extended walls 62 along two major sides of each first lower board 6. Each second lower board 6 has two downwardly extended walls 62 along two major sides of each second lower board 6. The distance between the two opposing walls 62 on a first or second lower board 6 is identical to the outer diameter of each support tube 2. As such, each support tube 2 has its upper and lower ends both limited and reinforced by the walls 62 so as to achieve enhanced strength.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A recyclable pallet, comprising:

an upper board(1) having a plurality of through upper board holes(11), each surrounded by a plurality of slots (12), each upper board hole(11) and its surrounded slots (12) constituting an unit of the upper board(1);

a plurality of caps(4), each having a through cap hole(41) and a plurality of protrusions(42) extended downward from the cap(4)'s circumference, each protrusion(42) corresponding to and plugged downward into a slot(12);

a plurality support tubes(2), each having a through axial channel(21) and positioned beneath the upper board, each support tube(2) having an inner diameter and an outer diameter such that the slots(12) of a unit are projected between a support tube(2)'s inner and outer diameters;

a plurality of stands(3), each having a platform(31) on an upper side of the stand(3) whose outer diameter matches the inner diameter of each support tube(2), an axial pin(32) extended upward from an upper side of the platform(31), an upper end of each axial pin(32) having an axial bolt hole(321); and a plurality of bolts(5), each threaded downward through a cap hole(41), an upper board hole(11), and then screwed into the bolt hole(321) of a pin(32) of a stand(3).

2. The recyclable pallet according to claim 1, wherein each platform(31) is plugged upward into a lower end of a support tube(2)'s through channel(21).

3. The recyclable pallet according to claim 1, further comprising a plurality of first lower boards(6), each having a plurality of through first lower board holes(61); wherein the pin(32) of each stand(3) is plugged upward into a first lower board hole(61); and each first lower board(6) is sandwiched between a plurality of support tubes(2) and a plurality of stands(3).

4. The recyclable pallet according to claim 3, wherein each first lower board(6) has two upwardly extended walls(62) along two major sides of the first lower board(6); and the distance between the two opposing walls(62) on each first lower board(6) is identical to the outer diameter of each support tube(2).

5. The recyclable pallet according to claim 4, wherein the upper board(1) has upwardly extended walls(13) along a circumference of the upper board(1).

6. The recyclable pallet according to claim 5, further comprising a plurality of second lower boards(6), each sandwiched between a plurality of support tubes(2) and the upper board(1), and each second lower board(6) corresponding to a first lower board(6) beneath the plurality of support tubes(2).

7. The recyclable pallet according to claim 3, wherein the upper board(1) has upwardly extended walls(13) along a circumference of the upper board(1).

* * * * *